US007186082B2

(12) United States Patent
Mongillo, Jr. et al.

(10) Patent No.: US 7,186,082 B2
(45) Date of Patent: Mar. 6, 2007

(54) COOLED ROTOR BLADE AND METHOD FOR COOLING A ROTOR BLADE

(75) Inventors: Dominic J. Mongillo, Jr., West Hartford, CT (US); Shawn J. Gregg, Wethersfield, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/855,010

(22) Filed: May 27, 2004

(65) Prior Publication Data

US 2005/0265836 A1 Dec. 1, 2005

(51) Int. Cl.
*F01D 5/18* (2006.01)

(52) U.S. Cl. ..... 416/1; 416/90 R; 416/97 R

(58) Field of Classification Search ..... 416/1, 416/90 R, 92, 96 R, 96 A, 97 R; 415/1, 415/115–116

See application file for complete search history.

(56) References Cited

U.S. PATENT DOCUMENTS 4,474,532 A * 10/1984 Pazder ..... 416/97 R
4,753,575 A * 6/1988 Levengood et al. ..... 416/97 R
5,403,159 A * 4/1995 Green et al. ..... 416/97 R
5,902,093 A * 5/1999 Liotta et al. ..... 416/97 R
5,931,638 A * 8/1999 Krause et al. ..... 416/97 R
6,168,381 B1 * 1/2001 Reddy ..... 416/97 R
6,595,748 B2 * 7/2003 Flodman et al. ..... 416/97 R

FOREIGN PATENT DOCUMENTS

EP 1 065 343 A2 1/2001

* cited by examiner

*Primary Examiner*—Christopher Verdier
(74) *Attorney, Agent, or Firm*—Colin L. Cini

(57) ABSTRACT

A rotor blade and a method for cooling a rotor blade are provided. The rotor blade includes a root and a hollow airfoil having a cavity defined by suction side wall, a pressure side wall, a leading edge, a trailing edge, a base, and a tip. An internal passage configuration is disposed within the cavity. The configuration includes a serpentine passage having at least three radial segments connected to one another, an axially extending passage disposed between the tip and the serpentine passage, at least one aperture extending between the last radial segment and the axially extending passage, and one or more sink apertures disposed within one of the suction side wall or the pressure side wall of the last radial segment of the serpentine passage. At least one conduit is disposed within the root. The conduit is operable to permit airflow through the root and into the internal passage configuration.

7 Claims, 4 Drawing Sheets

COOLED ROTOR BLADE AND METHOD FOR COOLING A ROTOR BLADE

BACKGROUND OF THE INVENTION

1. Technical Field

This invention applies to gas turbine rotor blades in general, and to cooled gas turbine rotor blades in particular.

2. Background Information

Turbine sections within an axial flow turbine engine include rotor assemblies that each include a rotating disc and a number of rotor blades circumferentially disposed around the disk. Rotor blades include an airfoil portion for positioning within the gas path through the engine. Because the temperatures within the gas path very often negatively affect the durability of the airfoil, it is known to cool an airfoil by passing cooling air through the airfoil. The cooled air helps decrease the temperature of the airfoil material and thereby increase its durability.

Prior art cooled rotor blades very often utilize internal passage configurations that include a leading edge passage that either dead-ends adjacent the tip, or is connected to the tip by a cooling aperture, or is connected to an axially extending passage that dead-ends prior to the trailing edge. All of these internal passage configurations suffer from airflow stagnation regions, or regions of relatively low velocity flow that inhibit internal convective cooling. The airfoil wall regions adjacent these regions of low cooling effectiveness are typically at a higher temperature than other regions of the airfoil, and are therefore more prone to undesirable oxidation, thermal mechanical fatigue (TMF), creep, and erosion.

What is needed, therefore, is an airfoil having an internal passage configuration that promotes desirable cooling of the airfoil and thereby increases the durability of the blade.

DISCLOSURE OF THE INVENTION

According to the present invention, a rotor blade is provided that includes a root and a hollow airfoil having a cavity defined by suction side wall, a pressure side wall, a leading edge, a trailing edge, a base, and a tip. An internal passage configuration is disposed within the cavity. The configuration includes a serpentine passage having at least three radial segments connected to one another, an axially extending passage disposed between the tip and the serpentine passage, at least one aperture extending between the last radial segment and the axially extending passage, and one or more sink apertures disposed within one of the suction side wall or the pressure side wall of the last radial segment of the serpentine passage. The "last radial segment" is defined as the last possible segment within the serpentine passage that can receive cooling air. At least one conduit is disposed within the root. The conduit is operable to permit airflow through the root and into the internal passage configuration.

A method for cooling a rotor blade is also provided. The method includes the steps of: (a) providing a rotor blade like the present invention rotor blade described above; (b) providing cooling air into the internal passage configuration at P1; (c) providing cooling air into the axially extending passage at P2; and (d) providing cooling air into last radial segment of the serpentine passage at P3, wherein P1>P2>P3. The difference between P2 and P3 causes cooling air to exit the axially extending passage and enter the last radial segment through the at least one aperture extending between the last radial segment and the axially extending passage. The difference between P1 and P2 enables cooling air to enter the serpentine passage.

One of the advantages of the present rotor blade and method is that airflow stagnation regions, and/or regions of relatively low velocity flow within the airfoil that inhibit internal convective cooling are decreased or eliminated. The airfoil walls are consequently able to accommodate high temperature environments with greater resistance to oxidation, TMF, creep, and erosion.

These and other objects, features and advantages of the present invention will become apparent in light of the detailed description of the best mode embodiment thereof, as illustrated in the accompanying drawings.

DETAILED DESCRIPTION OF THE INVENTION

Figure 1:
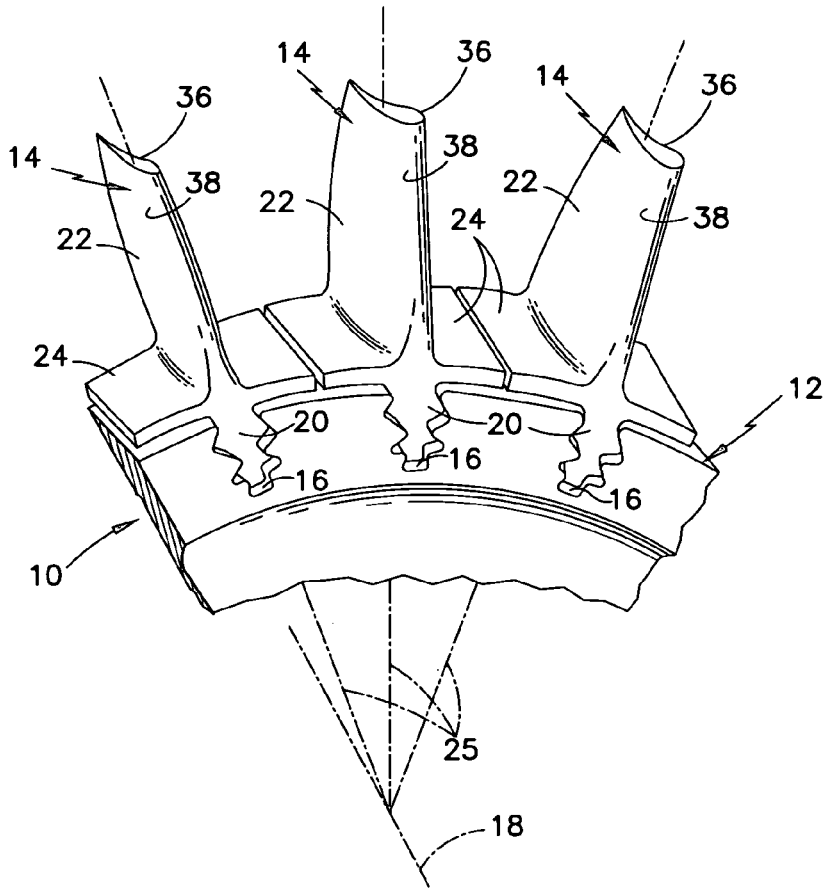
FIG. 1 is a diagrammatic perspective view of the rotor assembly section.

Referring to FIG. 1, a rotor blade assembly 10 for a gas turbine engine is provided having a disk 12 and a plurality of rotor blades 14. The disk 12 includes a plurality of recesses 16 circumferentially disposed around the disk 12 and a rotational centerline 18 about which the disk 12 may rotate. Each blade 14 includes a root 20, an airfoil 22, a platform 24, and a radial centerline 25. The root 20 includes a geometry (e.g., a fir tree configuration) that mates with that of one of the recesses 16 within the disk 12. As can be seen in FIGS. 2–5, the root 20 further includes conduits 26 through which cooling air may enter the root 20 and pass through into the airfoil 22.

Referring to FIGS. 1–5, the airfoil 22 includes a base 28, a tip 30, a leading edge 32, a trailing edge 34, a pressure side wall 36 (see FIG. 1), and a suction side wall 38 (see FIG. 1), and an internal passage configuration 40. FIGS. 2–5 diagrammatically illustrate an airfoil 22 sectioned between the leading edge 32 and the trailing edge 34. The pressure side wall 36 and the suction side wall 38 extend between the base 28 and the tip 30 and meet at the leading edge 32 and the trailing edge 34.

The internal passage configuration 40 includes a first conduit 42, a second conduit 44, and a third conduit 46 extending through the root 20 into the airfoil 22. The first conduit 42 is in fluid communication with one or more leading edge passages 48 ("LE passages") disposed adjacent the leading edge 32. The first conduit 42 provides the primary path into these LE passages 48 for cooling air, and therefore the leading edge 32 is primarily cooled by the cooling air that enters the airfoil 22 through the first conduit 42.

Figure 2:
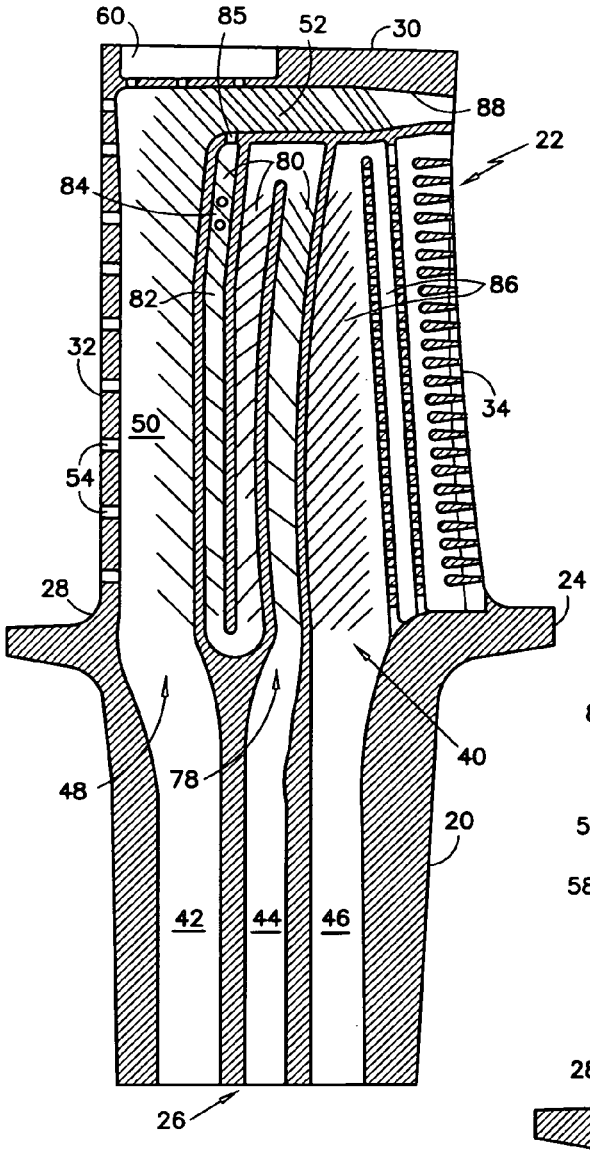
FIG. 2 is a diagrammatic sectional view of a rotor blade having an embodiment of the internal passage configuration.

Referring to FIG. 2, in a first embodiment of the one or more LE passages 48, the first conduit 42 is in fluid communication with a single LE passage 50, and that passage 50 is contiguous with the leading edge 32. At the outer radial end of the LE passage 50 (i.e., the end of the LE passage 50 opposite the first conduit 42), the LE passage 50 is connected to an axially extending passage 52 ("AE passage") that extends between the LE passage 50 and the trailing edge 34 of the airfoil 22, adjacent the tip 30 of the airfoil 22. The LE passage 50 is connected to the exterior of the airfoil 22 by a plurality of cooling apertures 54 disposed along the leading edge 32.

Figure 3:
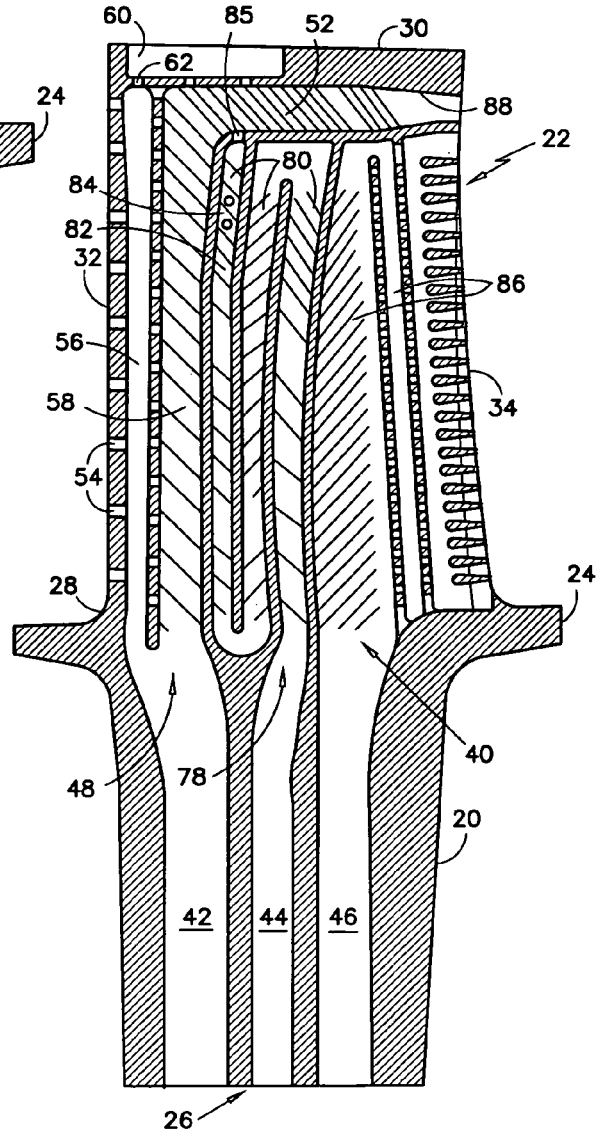
FIG. 3 is a diagrammatic sectional view of a rotor blade having an embodiment of the internal passage configuration.

Referring to FIG. 3, in a second embodiment of the one or more LE passages 48, the first conduit 42 is in fluid communication with a first LE passage 56 and a second LE passage 58. The first LE passage 56 is contiguous with the leading edge 32, and the second LE passage 58 is immediately aft and adjacent the first LE passage 56. The first LE passage 56 is connected to the exterior of the airfoil 22 by a plurality of cooling apertures 54 disposed along the leading edge 32. In some embodiments, the first LE passage 56 is also connected to the tip 30 or a tip pocket 60 by one or more apertures 62. At the outer radial end of the second LE passage 58 (i.e., the end of the second LE passage 58 opposite the first conduit 42), the second LE passage 58 is connected to an AE passage 52 that extends to the trailing edge 34 of the airfoil 22, adjacent the tip 30 of the airfoil 22.

Figure 4:
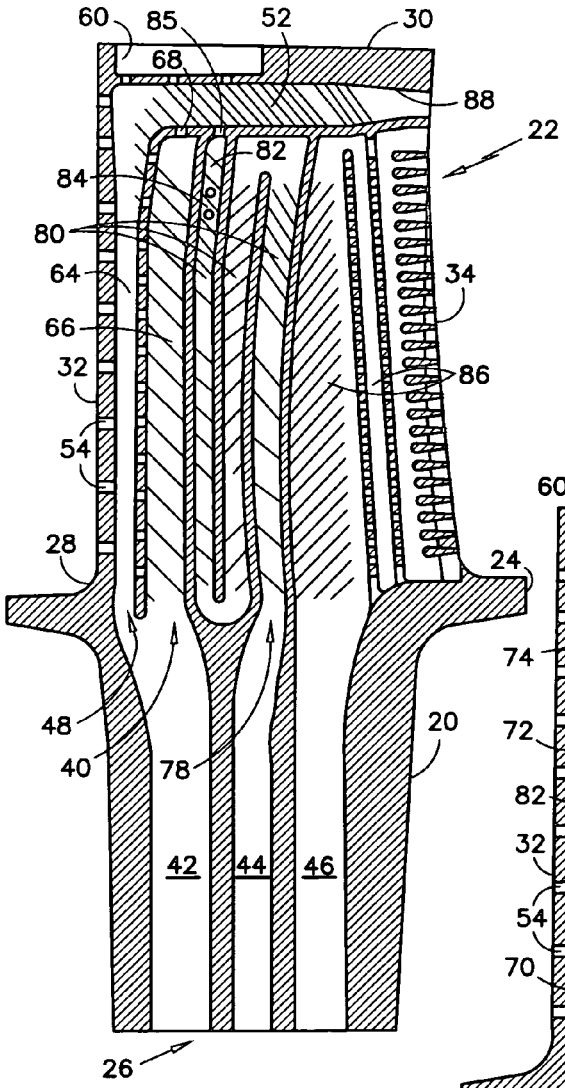
FIG. 4 is a diagrammatic sectional view of a rotor blade having an embodiment of the internal passage configuration.

Referring to FIG. 4, in a third embodiment of the one or more LE passages 48, the first conduit 42 is in fluid communication with a first LE passage 64 and a second LE passage 66. The first LE passage 64 is contiguous with the leading edge 32, and the second LE passage 66 is immediately aft and adjacent the first LE passage 64. The first LE passage 64 is connected to the exterior of the airfoil 22 by a plurality of cooling apertures 54 disposed along the leading edge 32. At the outer radial end of the first LE passage 64 (i.e., the end of the first LE passage 64 opposite the first conduit 42), the first LE passage 64 is connected to an AE passage 52 that extends to the trailing edge 34 of the airfoil 22, adjacent the tip 30 of the airfoil 22. The second LE passage 66 ends radially below the AE passage 52. One or more apertures 68 disposed in the rib between the AE passage 52 and the second LE passage 66 permits airflow therebetween.

Figure 5:
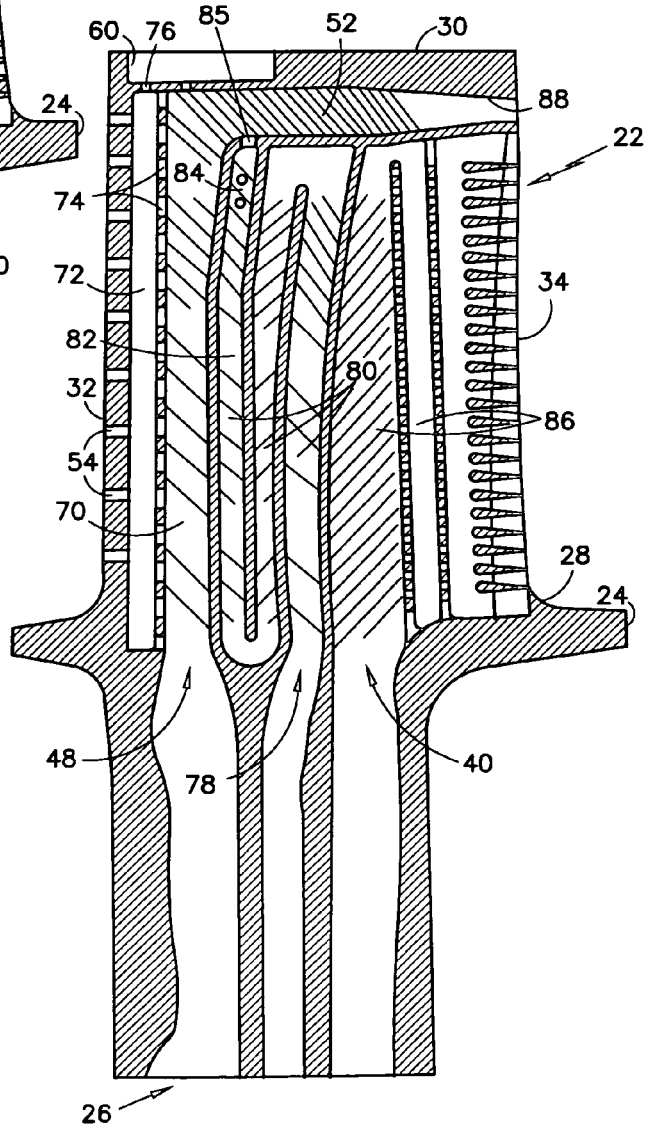
FIG. 5 is a diagrammatic sectional view of a rotor blade having an embodiment of the internal passage configuration.
Figure 6:
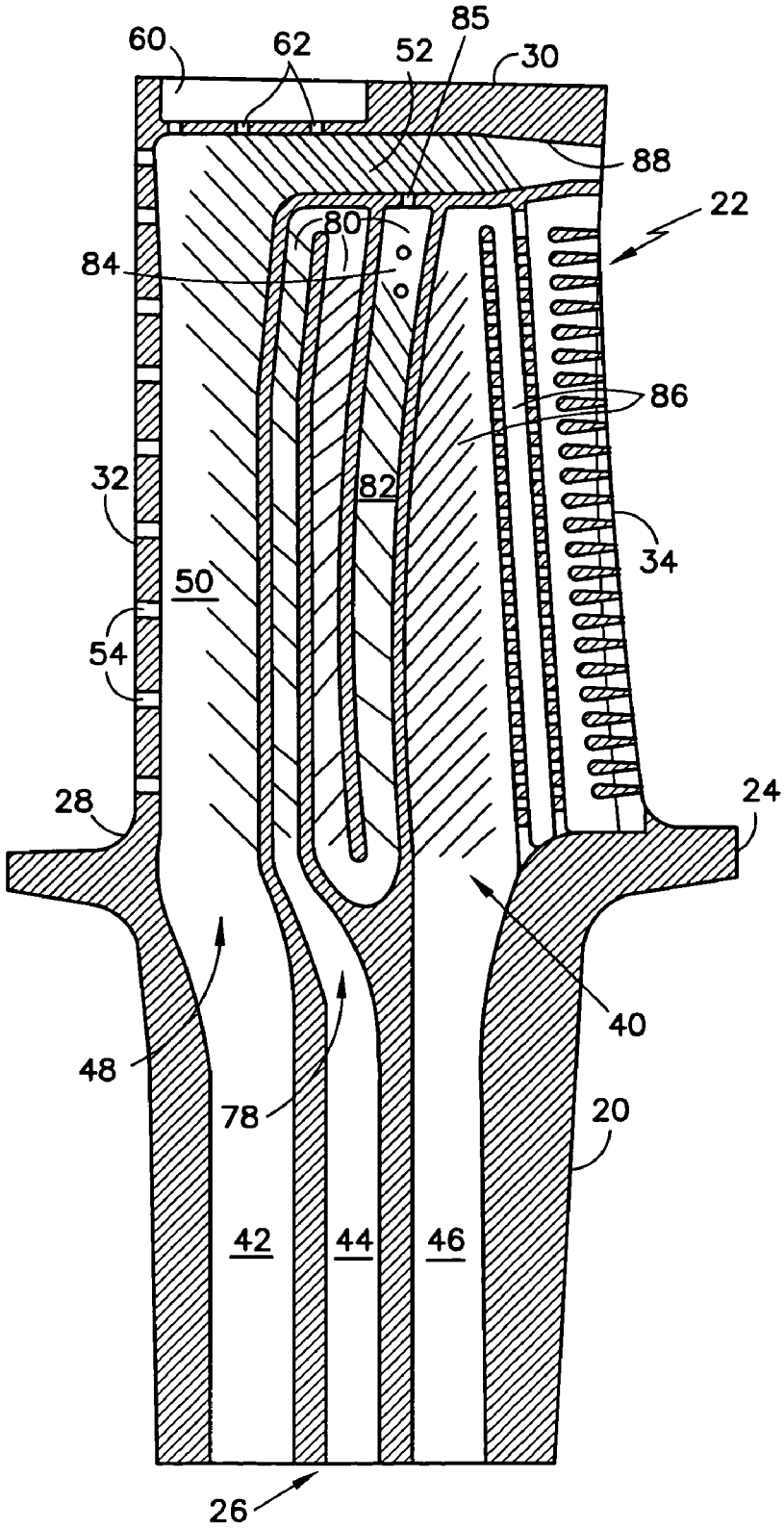
FIG. 6 is a diagrammatic sectional view of a rotor blade having an embodiment of the internal passage configuration.

Referring to FIG. 5, in a fourth embodiment of the one or more LE passages 48, the first conduit 42 is in fluid communication with a single LE passage 70. One or more cavities 72 are disposed forward of the LE passage 70, connected to the LE passage 70 by a plurality of crossover apertures 74. The one or more cavities 72 are contiguous with the leading edge 32. The one or more cavities 72 are connected to the exterior of the airfoil 22 by a plurality of cooling apertures 54 disposed along the leading edge 32. In some embodiments, the cavity 72 (or the outer most radial cavity if more than one cavity) is also connected to the tip 30 or a tip pocket 60 by one or more apertures 76. At the outer radial end of the LE passage 70 (i.e., the end of the LE passage 70 opposite the first conduit 42), the LE passage 70 is connected to an AE passage 52 that extends to the trailing edge 34 of the airfoil 22, adjacent the tip 30 of the airfoil 22.

Referring to FIGS. 2–5, the second conduit 44 is in fluid communication with a serpentine passage 78 disposed immediately aft of the LE passages, in the mid-body region of the airfoil 22. The second conduit 44 provides the primary path into the serpentine passage 78 for cooling air, and therefore the mid-body region is primarily cooled by the cooling air that enters the airfoil 22 through the second conduit 44. The serpentine passage 78 has an odd number of radial segments 80, which number is greater than one; e.g., 3, 5, etc. The odd number of radial segments 80 ensures that the last radial segment 82 in the serpentine 78 ends adjacent the AE passage 52. The radial segments 80 are connected to one another by turns of approximately 180°; e.g., the first radial segment is connected to the second radial segment by a 180° turn, the second radial segment is connected to the third radial segment by a 180° turn, etc. The serpentine passage 78 shown in FIGS. 2–5 is oriented so that the path through the serpentine 78 directs the cooling air forward; i.e., toward the leading edge 32 of the airfoil 22. In alternative embodiments, the serpentine 78 can also be oriented so that cooling air is directed aft, toward the trailing edge 34 of the airfoil 22. In some embodiments, a cooling air sink 84, typically in the form of one or more cooling apertures, is disposed within the exterior wall (e.g., the suction side wall) of the last segment 82, sized to permit cooling airflow out of the airfoil 22. In a preferred embodiment, the one or more cooling apertures are film holes. One or more apertures 85 extend through the rib separating the last radial segment 82 and the AE passage, thereby permitting fluid communication therebetween.

The third conduit 46 is in fluid communication with one or more passages 86 disposed between the serpentine passage 78 and the trailing edge 34 of the airfoil 22. With the exception of the portion of the trailing edge 34 adjacent the tip 30 of the airfoil 22, the third conduit 46 provides the primary path for cooling air into the trailing edge 34, and therefore the trailing edge 34 is primarily cooled by the cooling air that enters the airfoil 22 through the third conduit 46. As stated above, the portion of the trailing edge 34 adjacent the tip 30 of the airfoil 22 is cooled by cooling air passing through the AE passage 52.

In a preferred embodiment the AE passage 52 trailing edge 34 exit aperture area is chosen to cause the cooling airflow exiting the AE passage 52 to choke. The resultant high velocity cooling airflow in the AE passage 52 provides significantly increased internal convection to the tip 30, pressure-side wall 36, and suction-side wall 38. A tapered segment 88 may be utilized to decrease the AE passage 52 cross-sectional area and accelerate the cooling airflow. The specific rate of decrease in cross-sectional area is chosen to suit the application at hand.

In the embodiments shown in FIGS. 2–5, the transition between the LE passage(s) and the AE passage 52 is approximately a ninety degree (90°) turn that has been optimized to minimize pressure loss as cooling air travels between the LE passage(s) and the AE passage 52. For example, the LE passage 50,58,64,70 increases in width as it approaches the turn. As a result the cross-sectional area is increased causing the coolant velocity to decrease. This provides for reduced pressure loss around the turn.

All of the foresaid passages (including AE passage 52) may include one or more cooling apertures and/or cooling features (e.g., trip strips, pedestals, pin fins, etc.) to facilitate heat transfer within the particular passage. The exact type(s) of cooling aperture and/or cooling feature can vary depending on the application, and more than one type can be used. The present invention can be used with a variety of different cooling aperture and cooling feature types and is not, therefore, limited to any particular type.

Some embodiments further include a tip pocket 60 disposed radially outside of the AE passage 52. The tip pocket 60 is open to the exterior of the airfoil 22. One or more apertures extend through a wall portion of the airfoil 22 disposed between the tip pocket 60 and the LE passage and/or the AE passage 52.

The above-described rotor blade 14 can be manufactured using a casting process that utilizes a ceramic core to form the cooling passages within the airfoil 22. The ceramic core is advantageous in that it is possible to create very small details within the passages; e.g., cooling apertures, trip strips, etc. A person of skill in the art will recognize, however, that the brittleness of a ceramic core makes it is difficult to use. The above-described rotor blade internal passage configurations 40 facilitate the casting process by including features that increase the durability of the ceramic core. For example, the first and second LE passage embodiments permit the use of a rod extending from the tip pocket 60, through the AE passage 52, and into the serpentine passage 78. The rod supports: 1) the core portion that forms the tip pocket 60; 2) the core portion that forms the AE passage 52; and 3) the core portion that forms the serpentine passage 78. The rod is removed at the same time the ceramic core is removed, leaving apertures between the tip pocket 60 and the AE passage 52, and between the AE passage 52 and the serpentine passage 78. Core-ties can also be used between core portions.

Another feature of the present internal passage configurations that increases the durability of the ceramic core is the AE passage 52 adjacent the tip 30 of the airfoil 22. The extension of the passage 52 to the trailing edge 34 enables the passage 52 and the trailing edge 34 core portion to be tied together by a stringer that is disposed outside the exterior of the airfoil 22. The core portions representing internal cooling passages (e.g., one of more segments of the serpentine passage 78) may also be supported by the AE passage 52 via rods or core-ties.

In the operation of the invention, the airfoil 22 portion of the rotor blade 14 is disposed within the core gas path of the turbine engine. The airfoil 22 is subject to high temperature core gas passing by the airfoil 22. Cooling air, that is substantially lower in temperature than the core gas, is fed into the airfoil 22 through the conduits 42,44,46 disposed in the root 20.

Cooling air traveling through the first conduit 42 passes directly into the one or more LE passages 48 disposed adjacent the leading edge 32, and subsequently into the AE passage 52 adjacent the tip 30 of the airfoil 22. The first conduit 42 provides the primary path into these passages 48 for cooling air, although the exact path depends upon the particular LE passage embodiment.

The relatively large and unobstructed LE passages 48 and AE passage 52 permit a volume rate of flow that provides a desirable amount of cooling to the leading edge 32, and tip 30. More specifically, the present LE passage(s) and AE passage configurations enable cooling airflow at a relatively high Mach number and heat transfer coefficient along substantially the entire radial span of the airfoil leading edge 32 and along substantially the entire axial span of the tip 30. The high Mach number and heat transfer coefficient of the flow are particularly helpful in producing improved convective heat transfer adjacent the suction side portion of the leading edge 32 and the tip 30. The suction side portion of the leading edge 32 has historically been subject to increased oxidation distress due to high external heat load and limited backside cooling. The limited backside cooling is a function of cooling airflow having a low Reynolds number and rotational effects attributable to buoyancy and corriollis; i.e., flow characteristics typically found in leading edge cavity configurations that terminate at the blade tip.

Cooling air traveling through the first conduit 42 into the first embodiment of the one or more LE passages 48 incurs relatively low pressure losses, and will enter the AE passage 52 at a relatively high pressure and velocity. Because the first embodiment of the one or more LE passages 48 is a single passage 50 contiguous with the leading edge 32, the cooling air is subject to heat transfer from the leading edge 32, the pressure side wall 36, and the suction side wall 38. In this embodiment, the AE passage 52 extends across the entire chord of the airfoil 22.

Cooling air traveling through the first conduit 42 into the second embodiment of the one or more LE passages 48 is divided between the first LE passage 56 and the second LE passage 58. The cooling air entering the first LE passage 56 travels contiguous with the leading edge 32, and is subject to heat transfer from the leading edge 32, the pressure side wall 36, and the suction side wall 38. The cooling air traveling within the first LE passage 56 exits via cooling apertures 54 disposed along the radial length of the leading edge 32, and through one or more cooling apertures 62 disposed between the radial end of the passage 56 and the tip 30 (or tip pocket 60). The apertures 62 disposed at the radial end prevent cooling airflow stagnation within the first LE passage 56. Cooling air traveling within the second LE passage 58 incurs relatively low pressure losses, and will enter the AE passage 52 at a relatively high pressure and velocity. Because the second LE passage 58 is aft of the first LE passage 56 (and therefore the leading edge 32), the cooling air traveling through the second LE passage 58 is subject to less heat transfer from the leading edge 32. As a result, the cooling air reaches the AE passage 52 typically at a lower temperature than it would be if it were in contact with the leading edge 32. In this embodiment, the AE passage 52 extends across nearly the entire chord of the airfoil 22.

Cooling air traveling through the first conduit 42 into the third embodiment of the one or more LE passages 48 is divided between the first LE passage 64 and the second LE passage 66. The cooling air entering the first LE passage 64 incurs relatively low pressure losses, and will enter the AE passage 52 at a relatively high pressure and velocity. The cooling air entering the second LE passage 66 will likewise flow substantially unobstructed until the radial end is reached. Cooling air can exit the second LE passage 66 through one or more cooling apertures 68 disposed in the rib separating the second LE passage 66 and the AE passage 52, or through cooling apertures disposed within the walls of the airfoil 22. The apertures 68 disposed at the radial end prevent cooling airflow stagnation within the second LE passage 66. In this embodiment, the AE passage 52 extends across the entire chord of the airfoil 22.

Cooling air traveling through the first conduit 42 into the fourth embodiment of the one or more LE passages 48 incurs relatively low pressure losses, and will enter the AE passage 52 at a relatively high pressure and velocity. A portion of the cooling air traveling within the LE passage 48 enters the cavity(ies) 72 disposed between the LE passage 70 and the leading edge 32. The cooling air traveling within the cavity 72 exits via cooling apertures 54 disposed along the radial length of the leading edge 32, and through one or more cooling apertures 76 disposed between the radial end of the cavity 72 and the tip 30 (or tip pocket 60). The apertures 76 disposed at the radial end prevent cooling airflow stagnation within the cavity 72. Because the LE passage 70 is aft of cavity(ies) 72 (and therefore the leading edge 32), the cooling air traveling through the LE passage 70 is subject to less heat transfer from the leading edge 32. As a result, the cooling air reaches the AE passage 52 typically at a lower temperature than it would be if it were in contact with the leading edge 32.

In all of the above embodiments, a portion of the cooling air passing through the AE passage 52 typically exits the AE passage 52 via cooling apertures; e.g., the cooling apertures extending between the tip 30, cavity 60, pressure side wall 36, and/or suction side wall 38. An advantage provided by the present internal passage configuration, and in particular by the AE passage 52 extending the length or nearly the length of the chord, is that manufacturability of the airfoil 22 is increased since cooling apertures can be drilled through the tip 30, pressure side wall 36, and/or suction side wall 38 without interference from ribs separating radial segments.

Cooling air traveling through the second conduit 44 enters the serpentine passage 78 at $P_1$. The cooling air passes through each radial segment 80 and 180° turn. A portion of the cooling air that enters the passage 78, exits the passage 78 via cooling apertures disposed in the walls of the airfoil 22. The remainder of the cooling air that enters the serpentine passage 78 will enter the last radial segment 82 of the passage 78. With the present internal passage configurations, the cooling air that reaches the last radial segment 82 will typically be at a pressure $P_3$ that is lower than the pressure $P_2$ of the cooling air in the adjacent region of the AE passage 52 (e.g., because of head losses incurred within the serpentine passage 78), wherein $P_1>P_2>P_3$. In those instances, cooling air will enter the last radial segment 82 from the AE passage 52 via the one or more apertures 85 extending between the last radial segment 82 and the AE passage 52 ($P_2>P_3$). To accommodate the inflow from the AE passage 52, a cooling air sink 84 (e.g., film holes) is disposed within the exterior wall of the last segment (e.g., the suction side wall 38), sized to permit cooling airflow out of the airfoil 22. The cooling air sink 84 prevents undesirable flow stagnation within the last radial segment 82 of the serpentine passage 78. The two opposing flows of cooling air within the serpentine passage 78 will come to rest at a location where the static pressure of each flow equals that of the other. Preferably, the cooling air sink 84 is positioned adjacent that rest location. The pressure $P_1$ of the cooling air entering the serpentine passage 78 prevents the AE passage 52 inflow from traveling completely through the serpentine passage 78 ($P_1>P_2$).

Cooling air traveling through the third conduit 46 enters one or more passage(s) 86 disposed between the serpentine passage 78 and the trailing edge 34. All of the cooling air that enters these passages exits via cooling apertures disposed in the walls of the airfoil 22 or along the trailing edge 34.

Although this invention has been shown and described with respect to the detailed embodiments thereof, it will be understood by those skilled in the art that various changes in form and detail thereof may be made without departing from the spirit and the scope of the invention.

What is claimed is:

1. A method for cooling a rotor blade, comprising the steps of:

providing a rotor blade having a root, and a hollow airfoil, wherein the hollow airfoil has a cavity defined by a suction side wall, a pressure side wall, a leading edge, a trailing edge, a base, and a tip, and an internal passage configuration is disposed within the cavity, which configuration includes a serpentine passage having at least three radial segments connected to one another, an axially extending passage disposed between the tip and the serpentine passage, at least one aperture extending between the last radial segment and the axially extending passage, and one or more sink apertures disposed within one of the suction side wall or the pressure side wall of the last radial segment of the serpentine passage, and wherein the rotor blade includes at least one conduit disposed within the root that is operable to permit airflow through the root and into the internal passage configuration;

providing cooling air into the internal passage configuration at a pressure of P1;

providing cooling air into the axially extending passage at a pressure of P2; and providing cooling air into the last radial segment of the serpentine passage at a pressure of P3, wherein P1>P2>P3;

wherein the difference between P2 and P3 causes cooling air to exit the axially extending passage through the at least one aperture extending between the last radial segment and the axially extending passage; and wherein the difference between P1 and P2 enables cooling air to enter the serpentine passage.

2. The method of claim 1, wherein the internal passage configuration further comprises a leading edge passage disposed between the leading edge and the serpentine passage, and the leading edge passage is in fluid communication with the axially extending passage, and wherein the cooling air provided within the axially extending passage enters the axially extending passage from the leading edge passage.

3. The method of claim 2, wherein cooling air provided within the axially extending passage exits the axially extending passage at the trailing edge of the airfoil.

4. The method of claim 1, wherein the one or more sink apertures are positioned within the last radial segment at a location where a static P2 equals a static P3.

5. The method of claim 1, wherein the one or more sink apertures are formed to produce film cooling.

6. The method of claim 1, wherein the serpentine passage is oriented to so that the path through the serpentine is operable to direct cooling air toward the leading edge of the airfoil.

7. The method of claim 1, wherein the serpentine passage is oriented to so that the path through the serpentine is operable to direct cooling air toward the trailing edge of the airfoil.

* * * * *